United States Patent [19]

Denley

[11] Patent Number: 4,792,376

[45] Date of Patent: Dec. 20, 1988

[54] APPARATUS FOR THE SUBLIMATION PRINTING OF KEYBOARD CAPS

[75] Inventor: Ronald S. Denley, Woodstock, Ill.

[73] Assignee: Oak Industries Inc., Rancho Bernardo, Calif.

[21] Appl. No.: 78,255

[22] Filed: Jul. 27, 1987

[51] Int. Cl.[4] ..... B44C 1/00; B30B 31/00; B30B 5/00; D06P 5/00

[52] U.S. Cl. ..... 156/540; 8/471; 100/211; 156/583.3; 156/583.91; 156/230

[58] Field of Search ..... 100/211, 93 P, 232, 100/237, 264, 265; 101/33, 41; 269/51, 54.4, 54.5, 71, 292, 295; 156/230, 232, 240, 239, 241, 274.4, 285, 361, 540, 541, 580, 583.3, 583.8, 583.9, 583.91; 8/468, 469, 470, 471, 472

[56] References Cited

U.S. PATENT DOCUMENTS

| | | | |
|---|---|---|---|
| 2,774,700 | 12/1956 | Killington | 100/237 |
| 4,152,193 | 5/1979 | Fitwater | 101/470 |
| 4,174,250 | 11/1979 | Duraud | 156/583.3 |
| 4,188,254 | 2/1980 | Hemperly, Jr. | 156/583.3 |
| 4,379,018 | 4/1983 | Griesdorn | 100/93 P |
| 4,587,155 | 5/1986 | Durand | 8/467 |
| 4,664,030 | 5/1987 | Siverson et al. | 8/470 |
| 4,670,084 | 6/1987 | Durand | 156/230 |

FOREIGN PATENT DOCUMENTS 645409 12/1928 France .

*Primary Examiner*—Michael W. Ball
*Assistant Examiner*—Louis Falasco
*Attorney, Agent, or Firm*—Kinzer, Plyer, Dorn, McEachran & Jambor

[57] ABSTRACT

An apparatus for printing keyboard keycaps includes a fixture for holding multiple keycaps in an essentially keyboard profile. The fixture supports the keycaps in separately movable segments, each having multiple keycaps. The spearately movable segments are movable from an essentially keyboard profile into an essentially planar printing profile. The printing apparatus includes an air inflatable heated bladder positioned to apply heat and pressure to a legend carrying medium positioned upon the keycaps to transfer the legends from the medium to the individual keycaps.

10 Claims, 6 Drawing Sheets

13
13
14
14
20
22
24
40
40
70
72
84
86
87
88
90
92
94
96
98
100
102
104
106
110
111
112
113
114
116
117
118
119
120
121

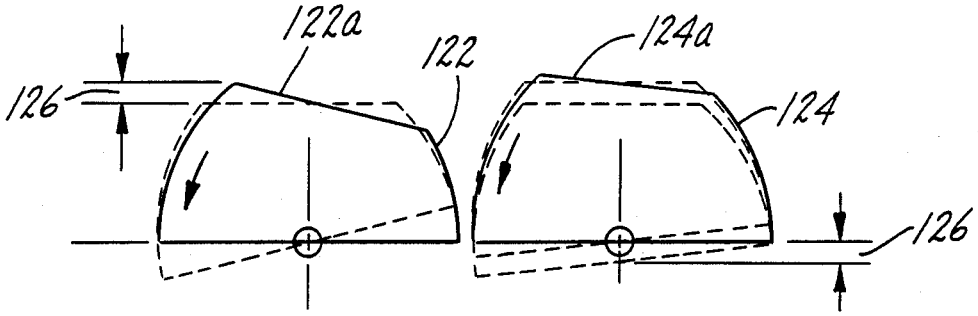
Fig. 11.
Fig. 12.
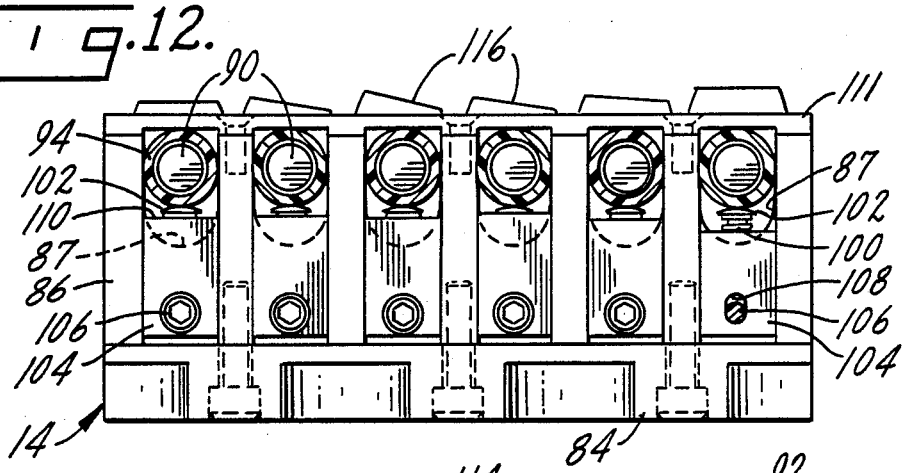
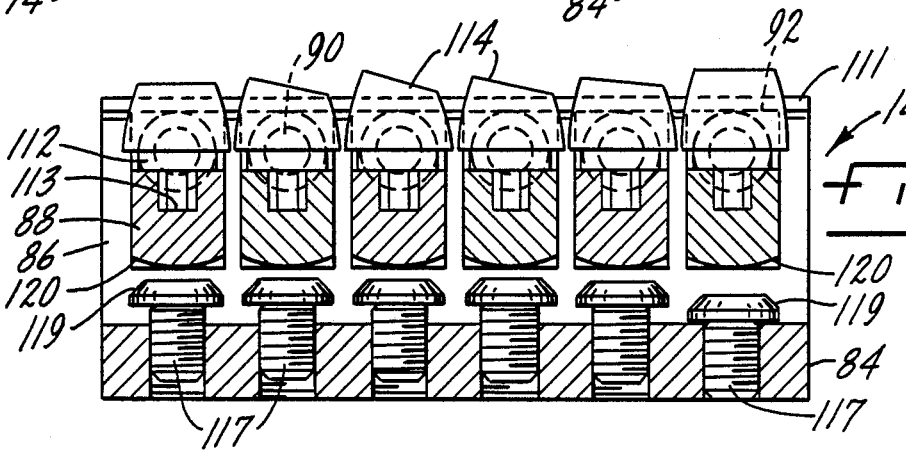
Fig. 13.
Fig. 14.
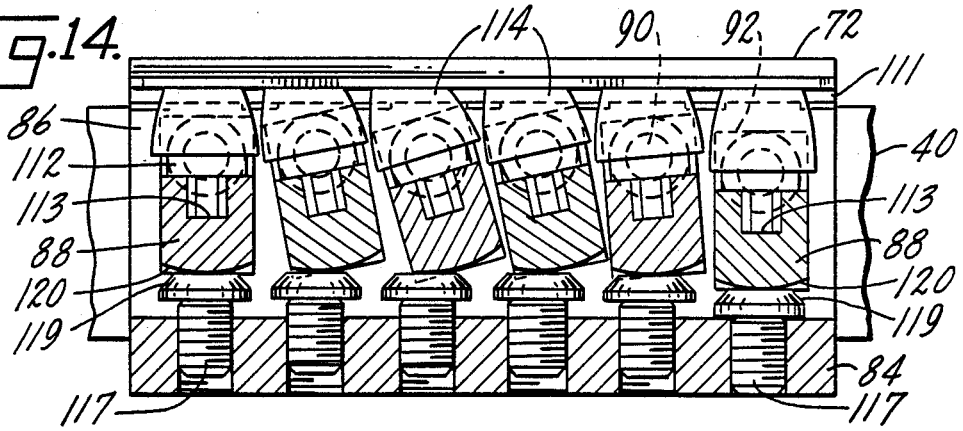

APPARATUS FOR THE SUBLIMATION PRINTING OF KEYBOARD CAPS

SUMMARY OF THE INVENTION

The present invention relates to an apparatus for printing keyboard keycaps and in particular to such an apparatus which utilizes a sublimation dry printing process.

A primary purpose of the invention is a keyboard keycap printing apparatus of the type described which utilizes an air inflatable heated bladder to transfer characters from a legend carrying medium to multiple keycaps.

Another purpose is a printing apparatus of the type described in which the air inflatable bladder is heated by heating elements positioned within a chamber adjacent the bladder, which heating elements are utilized in combination with parabolic reflectors to reflect heat toward the air inflatable bladder.

Another purpose is a printing apparatus of the type described which is universal in that it can print legends on keycaps in any array as long as the bladder is supported substantially entirely over the plane of the array.

Another purpose is a keyboard keycap printing apparatus which utilizes a fixture to hold the keycaps to be printed, which fixture supports the keycaps in an essentially keyboard profile, but which permits movement of groups of the keycaps into an essentially planar printing profile.

Another purpose is a printing apparatus of the type described which utilizes a sublimation dry printing process and which is reliable and simply constructed.

Another purpose is a printing apparatus of the type described utilizing an air inflatable heated bladder to apply heat and pressure to a legend carrying medium positioned upon an array of keyboard keycaps, which bladder can be used without change on different keyboard arrays.

Other purposes will appear in the ensuing specification, drawings and claims.

BRIEF DESCRIPTION OF THE DRAWINGS

The invention is illustrated diagrammatically in the following drawings wherein:

FIG. 11 is a diagrammatic illustration of the keycap movement which takes place when the transfer frame is used to move keycaps into an essentially planar printing plane, FIG. 12 is a side view of the printing fixture of FIG. 9, FIG. 13 is a section along plane 13—13 of FIG. 9, and FIG. 14 is a section, similar to FIG. 13, but showing the keycaps moved into an essentially planar printing plane by the transfer frame.

DESCRIPTION OF THE PREFERRED EMBODIMENT

Figures 1, 2:
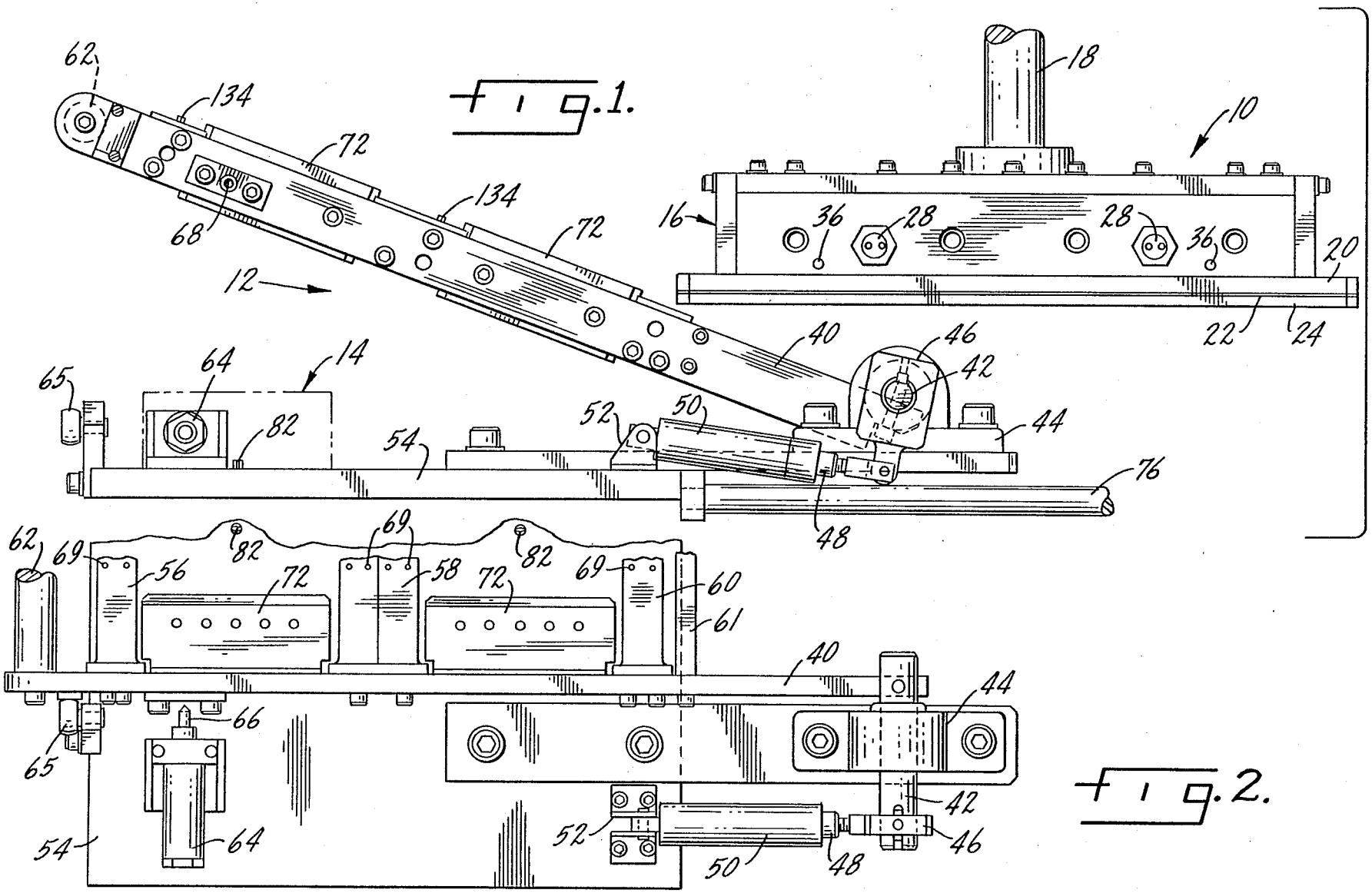
FIG. 1 is a side view of a keyboard keycap printing apparatus of the type described.
FIG. 2 is a partial top view of a portion of the apparatus of FIG. 1.

The present invention relates to an apparatus for printing legends on keyboard keycaps, for example of the type used in computer or typewriter keyboards. It is efficient to print the keycaps when such are arranged in a keyboard array, as this considerably reduces keyboard assembly time, particularly since it permits transfer of the keysets in one operation to the keyboard. Since there is substantial variation between keyboards, it is highly desirable to provide a printing apparatus which is universal in the sense that it can apply legends to a keyboard without regard to the disposition of the individual keycaps.

In prior printing apparatuses of the type described, it was common to place a legend carrying medium, usually a paper which has the legends imprinted thereon in position over a keyboard array and then to apply heat and pressure to the legend carrying medium to transfer the legends to the individual keycaps. In the past, such a transfer process has been done by melting the dye or ink in the legend carrying medium and softening the plastic of the keycaps to effect a transfer. This process is disclosed in U.S. Pat. No. 4,587,155. The present invention is more specifically concerned with sublimation dry printing in which the dye or ink is vaporized rather than melted during the transfer process.

Regardless of whether the process is one of sublimation or dry printing or the melting type of process disclosed in the above-mentioned U.S. patent, it has been the practice in the past to have individual heated silicon pads on the platen which apply heat and pressure to individual keycaps. Such a process was not cost effective in that the pads had to be individually positioned for each keyboard, depending upon the arrangement of keys. The pads degenerated at different rates, causing substantial variations in printing quality. Further, the keycaps are subject to distortion due to uneven pressures caused by vertical dimension variations between the printing platen, the fixture holding the keycaps, and the pads which are applying the heat and pressure to the legend carrying medium which is positioned upon the keycaps.

The present invention provides a means for the problems of the prior art in that the printing apparatus is universal is the sense that the specific configuration of the keycaps on the keyboard is irrelevant to the printing process. Printing is accomplished by a heated pressurized bladder which, as long as it is universally supported by the keyboard array, can apply heat and pressure uniformly to all keycaps in the array. Since a single bladder is used in the printing step, wear on the bladder is uniform and there are no individual elements which might have differential wear or which would permit uneven printing of individual keycaps during a single printing process.

The invention utilizes an air inflatable heated printing bladder which uniformly applies heat and pressure to keycaps arranged in a keyboard array. The keycaps are positioned on a fixture in which the keycaps are initially positioned in what is termed an essentially keyboard array in which there is a profile or contour to the keyboard, as is common in most typewriter and computer keyboards. During the printing process the keycaps are moved to an essentially planar printing plane so that the bladder, as described, may uniformly apply heat and pressure to the individual keycaps.

Figure 3:
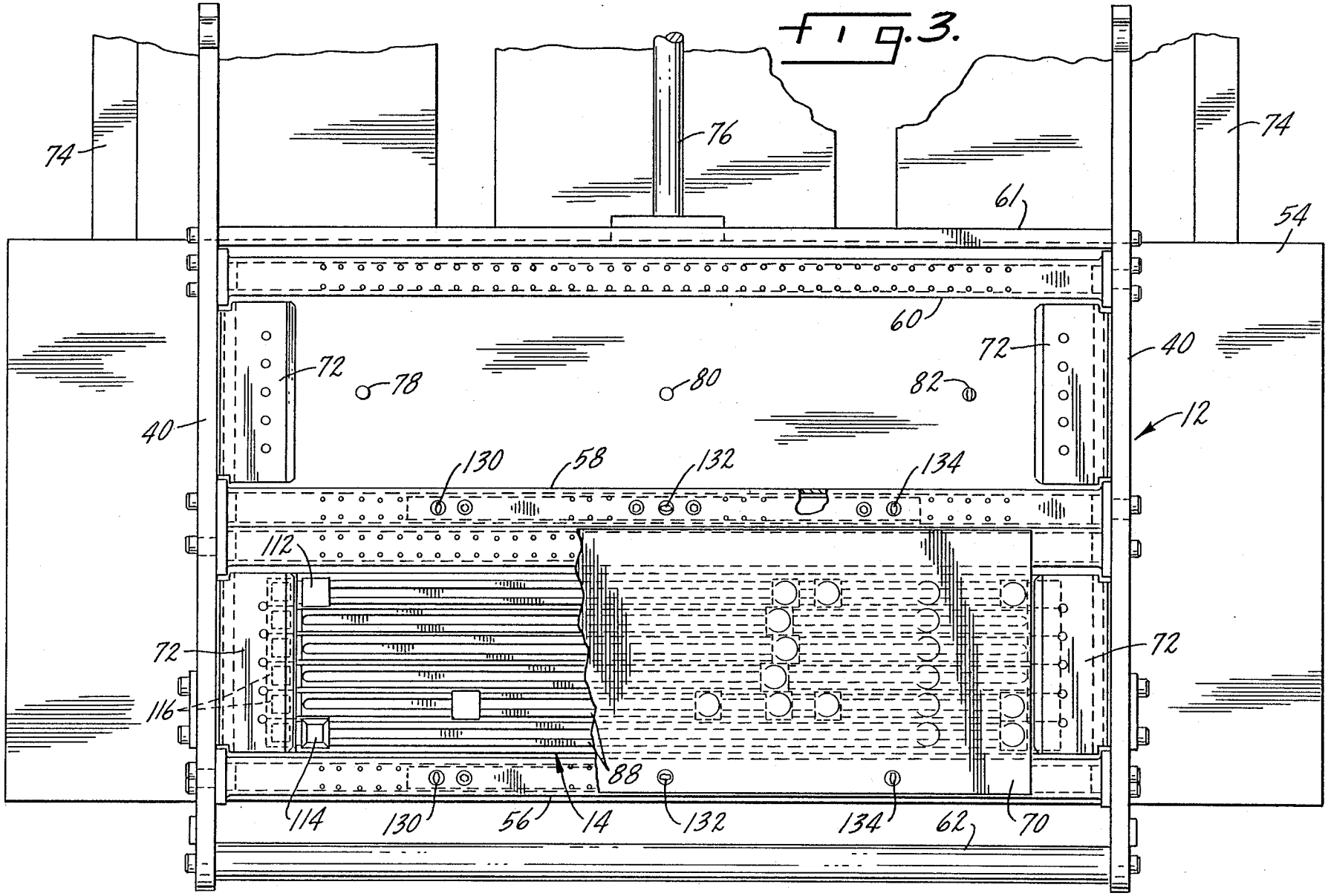
FIG. 3 is a partial top view of the printing apparatus of FIG. 1 with a keycap fixture in position thereon, the printing platen and other parts being omitted for clarity.

The printing apparatus disclosed includes three principal elements: the printing platen, indicated generally at 10; the transfer frame indicated generally at 12; and the printing fixture which supports the keycaps, indicated at 14 in FIG. 3, wherein the fixture is positioned upon the transfer frame.

Considering first the printing platen 10, there is a housing 16 which is mounted for reciprocal or up and down movement toward and away from the printing fixture by a shaft 18 which will be a part of a suitable controlled hydraulic press. As illustrated particularly in FIGS. 1, 4, 5 and 6, printing platen housing 16, includes a peripheral frame 20 which mounts a bladder 22 which is used to apply heat and pressure to the legend carrying medium in the printing process. Bladder 22, which preferably is formed of a silicon rubber, should be a material having relatively good heat transfer qualities and relatively high tear strength. The bladder must be able to withstand temperatures in the range of 500°-510° F. within the bladder chamber and the temperature actually applied to the keycaps during the printing process is on the order of about 350° F. Bladder 22 is held to frame 20 by a flange member 24 which is suitably bolted to the frame, thus rigidly securing the bladder in position.

Housing 16 and bladder 22 define a pair of chambers 26, with the chambers being in register with frame openings 29. There are two such chambers, as the printing apparatus is arranged to simultaneously print two keyboards, with the chambers being separated by a partition 32. Positioned within each of chambers 26 is a heating element 28 which may be an electrically heated quartz rod and which is positioned at the focus of a generally parabolic reflector 30. The heating rods will primarily heat that portion of the bladder which is positioned directly opposite the rod by reflection, but there will also be a heating of the air within the chamber and thus there will be radiant heat applied to the bladder. A particular advantage of having two independent heat chambers is that not only can two keyboards simultaneously have their keycaps printed, but if only one heating chamber is used at a time, and if the bladder should rupture opposite one of the chambers, the other chamber can be used and the printing process can continue.

Figure 4:
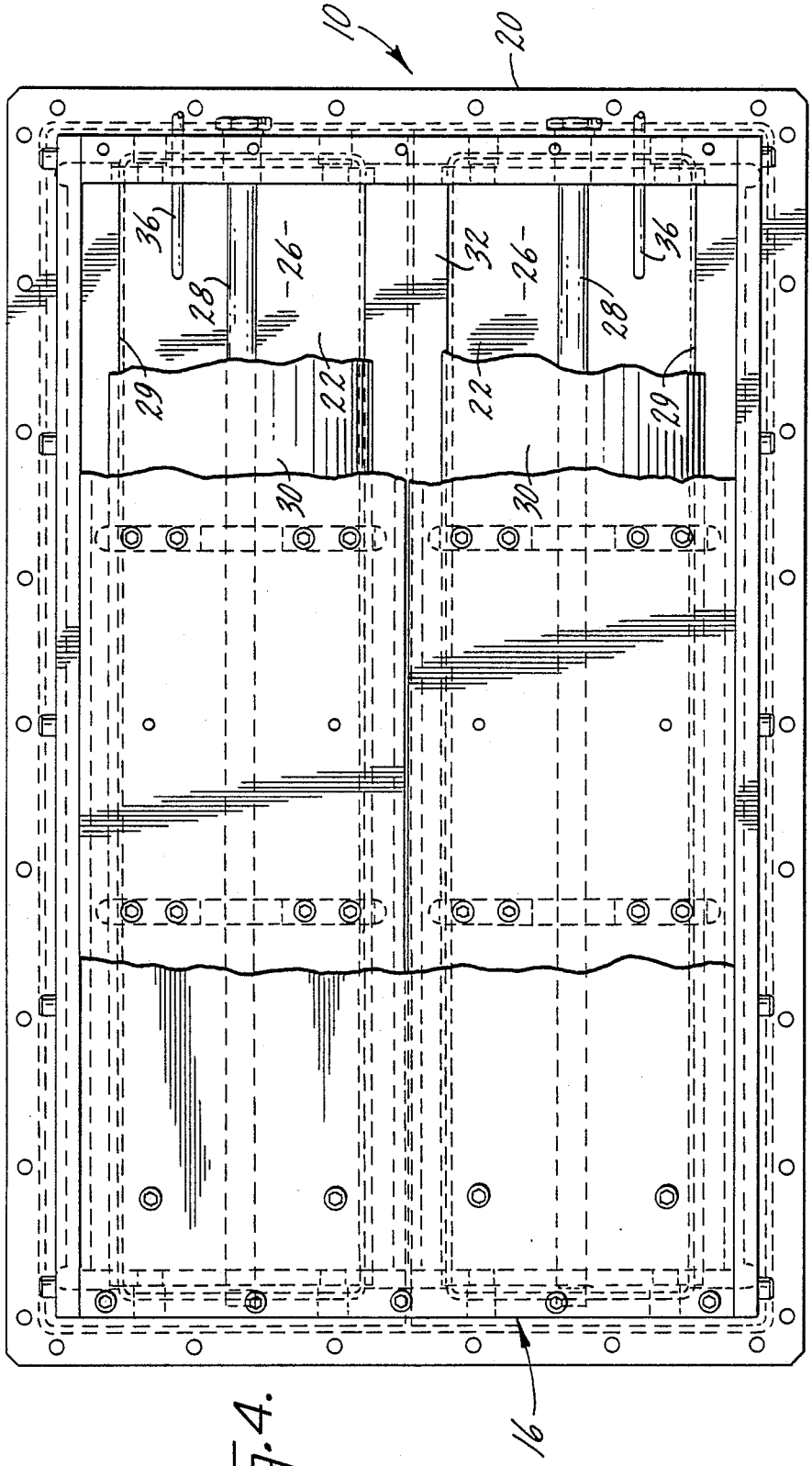
FIG. 4 is a top view of the printing platen of FIG. 1.
Figure 5:
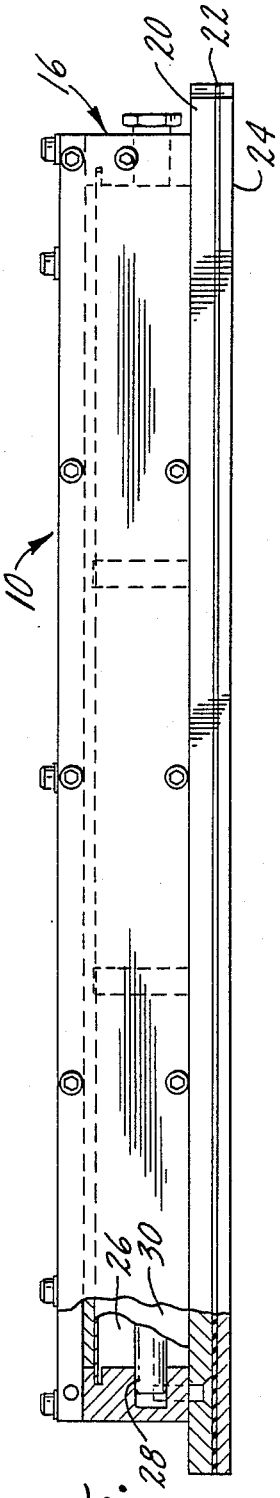
FIG. 5 is a front view, with portions broken away, illustrating the printing platen of FIG. 4.
Figure 6:
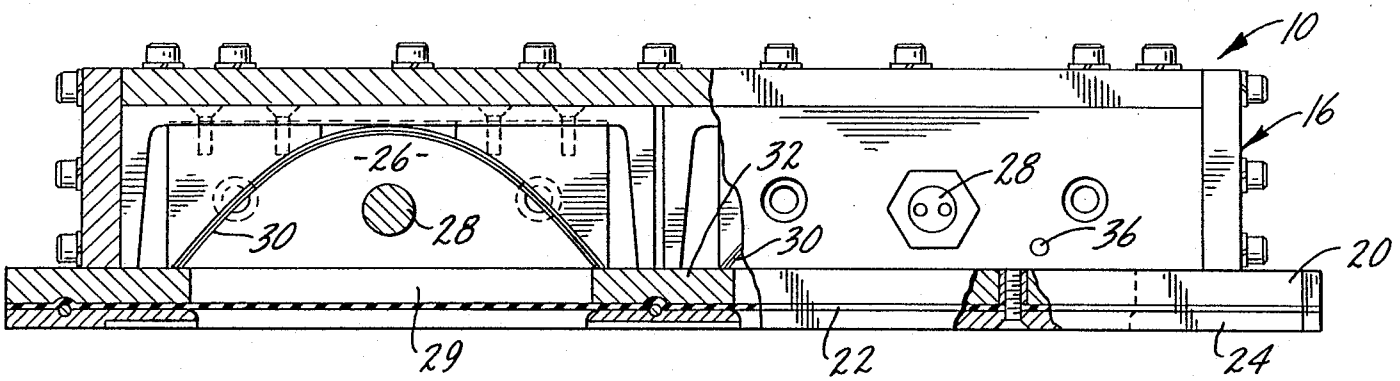
FIG. 6 is a side view, as viewed from the right, with portions exposed, illustrating the printing platen of FIGS. 4 and 5.
Figure 7:
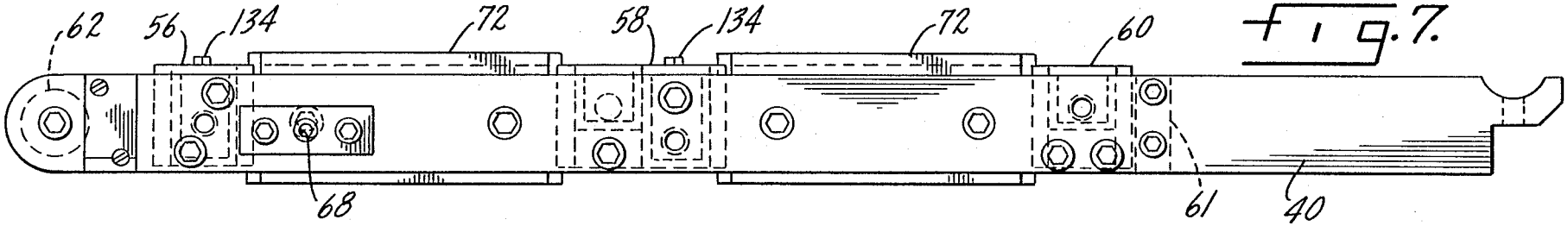
FIG. 7 is a partial side view of the transfer frame.
Figure 8:
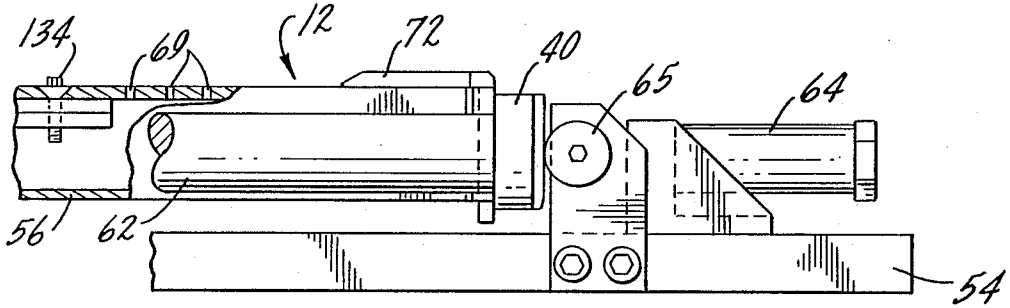
FIG. 8 is a partial side view of a portion of the transfer frame.

Each of the chambers within the printing platen has a temperature sensing element 36, illustrated in FIG. 4, so that during operation of the printing apparatus it is possible to sense and coordinate the temperature within the heated chambers and the time of application of heat and pressure in the printing process.

The transfer frame, as illustrated in FIGS. 2, 3, 7 and 8, includes a pair of arms 40, each of which is journaled on a shaft 42 mounted in a bearing block 44. The outboard end of shafts 42, as particularly illustrated in FIGS. 1 and 2, extends into a crank 46 which is connected to a piston 48 extending outwardly from a cylinder 50. Cylinders 50, there being one on each side of the apparatus, are pivoted in brackets 52 mounted upon a transfer frame bed 54.

Arms 40 are fastened together by cross braces 56, 58, 60 and 61, illustrated in FIG. 2, and by a hand grip 62. The arms and the cross braces together provide a frame which will position the legend carrying medium during printing. The frame is movable from the raised position of FIG. 1 to a down position in which the frame holds the printing fixtures upon bed 54. When the frame is lowered onto bed 54, it is held in that position by a pair of air actuated locking devices 64, one of which is indicated in FIG. 2. Each of the locking devices has an outwardly extending pin 66 which will move inwardly to be positioned within an opening 68 on arms 40. Rollers 65 insure that arms 40 are in alignment with printing fixtures 14.

Each of cross braces 56, 58 and 60 are hollow and have a plurality of aligned air holes 69 which are used to apply a vacuum to a legend carrying medium or paper which is positioned upon the printing fixtures. Such a legend carrying medium is indicated at 70 in FIGS. 3 and 10. There are two rows of holes 69 in each of cross braces 56 and 60 and four rows in cross brace 58, as two of the rows in cross brace 58 will be used for each of the two printing fixtures which are held by the transfer frame. Positioned on each side of the transfer frame and attached to arms 40 are actuator plates 72, two such plates being positioned to bear upon each of the printing fixtures 14 when positioned within the frame. The actuator plates will be more fully described hereinafter.

Although not shown, the individual openings or holes 69 will all be connected through the hollow braces 56, 58 and 60 into a common vacuum system for holding the paper 70 upon the printing fixtures.

Bed 54 is mounted upon a pair of rails 74 which are used to transfer the bed and the associated frame back and forth between a position beneath platen 10 for printing and a position, as illustrated in FIG. 1, in which the printing fixtures may be inserted on and removed from the transfer frame. Bed 54 will be moved by a pneumatic actuator 76, from the position of FIG. 1 to a position beneath the printing platen and back, as controlled by the printing operator.

As illustrated in FIG. 3, there are alignment means formed on bed 54 in order to properly position each of the printing fixtures. Such alignment means may take the form of a pin 78, a central opening 80 and a diamond-shaped pin 82 on the far right side. The alignment means insures that a fixture can only be placed in one position upon bed 54.

Turning now to the printing fixture which is illustrated in FIGS. 9-14, each of the printing fixtures 14 includes a base 84 having end members 86 extending upwardly on opposite sides thereof. The end members have vertical elongated openings, one for each rail, indicated at 87. The end members will carry a plurality of rails 88 by means of individual shafts 90 extending outwardly from openings in an upturned portion 92 of each of the rails 88. Shafts 90 extend through bearings 94, with bearings 94 each having outwardly directed flanges 96 at opposite ends thereof to secure the bearings within openings 87 of end members 86.

Each of the end members 86 will have a plurality of chambers, one for each rail, indicated at 98, with each of the chambers mounting a small coil spring 100 having a coaxially positioned pin 102 which bears upwardly upon bearing 94 to urge the bearings and thus each end of each of rails 88 in an upward direction.

Looking particularly at FIG. 12, which shows an end member 86 from the outside thereof, there are a plurality, one for each rail, of adjustable down stops 104, with each of the stops being fixed in an adjustable position by means of a small screw 106 which extends through an elongated slot 108 in the stop end into the end members 86. The upper edge 110 of each of the adjustable stops 104 determines the extent of downward movement by a rail, which downward movement would be against the upwardly directed force of springs 100. Upward movement of the rails is limited by up stops 111 fixed to the top of end members 86.

The rails, mounted as described, can have both up and down translational movement relative to the end members and can have pivotal movement relative to the end members as each end of the rails is pivotally mounted by shafts 90.

Each of rails 88 mounts a plurality of pedestals 112 which are axially movable along grooves 113 in the rails. The position of the pedestals is adjusted and fixed for each particular keyboard array. Each of the pedestals 112 will mount a keycap 114. As is known in the art, the profile of a typical keyboard is not flat, but has a sculptured or contoured configuration. Not only does the keyboard as a whole have a contour, but each of the individual keys within a given row may similarly be sculptured or contoured, as indicated in FIGS. 10 and 12–14. In order to print a legend on the keycaps, the keycaps must be moved from an essentially keyboard profile, such as indicated in FIGS. 12 and 13, to an essentially planar printing profile such as is indicated in FIG. 14. The translational and pivotal movement of the individual rails permits this to take place. The keycap at each end of each rail, which is designated an actuator keycap and is indicated at 116, is a keycap which is not to be printed, but is in effect a part of the printing fixture. As particularly shown in FIG. 10, the actuator plates 72 extend over keycaps 116 with the result that when the transfer frame is moved down upon one or two keycap fixtures positioned on bed 54, the actuator members 72, upon striking each of the end keycaps 116, will move the individual rails so that the keycaps thereon will assume a planar position as indicated in FIG. 14.

Figures 9, 10:
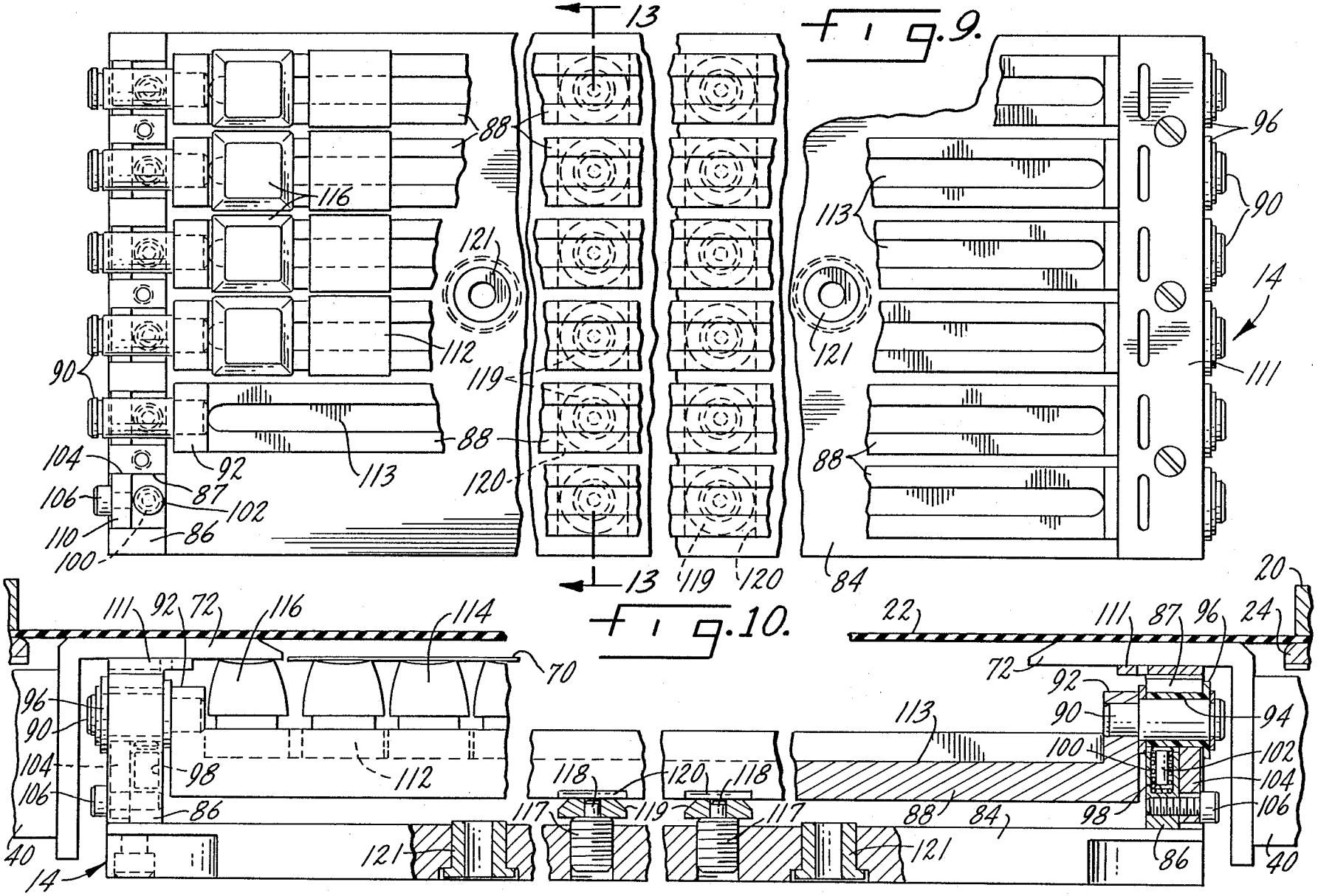
FIG. 9 is a top view, with portions omitted, of the printing fixture apparatus showing keycaps positioned thereon.
FIG. 10 is a front view of the printing fixture of FIG. 9, as positioned within the transfer frame.

Each of the rails is supported not only by end members 86, but by intermediately positioned adjustable set screws 117 illustrated particularly in FIG. 10. The upper ends of adjustment screws 117 have a pin 118 which carries a somewhat tapered nose 119 which fits within a small arcuate groove 120 in the bottom of the rails. There are two such adjustment screws for each of the rails.

FIG. 11 illustrates the two dimensional movement which takes place when individual keycaps move from an essentially keyboard profile to an essentially planar printing profile. The initial keyboard profile position of the keycaps is indicated in full lines. The two keycaps are indicated at 122 and 124 and each has its bottom surface in the same plane, with the upper surfaces differing both in height and in profile. When pressure is applied in a downward direction by actuators 72, the initial movement is for the keycaps to pivot so that the upper surfaces thereof, indicated at **122*a* and 124*a*, move to parallel planes. When the upper surfaces are in parallel planes, they differ in height by a distance 126 indicated at the left side of FIG. 11. Continued downward movement of actuators 72 will cause keycap 124, after its pivotal movement as indicated by the arrow thereon, to move downward the distance 126 so that the upper surfaces 122*a* and 124*a*** of the two keycaps now lie in the same plane which will be the plane for printing.

As can be seen, the rails will permit both up and down translational movement and pivotal movement of the rail as a whole. All of the keycaps on a particular rail have the same shape and contour and this shape and contour is the same as the actuator keycaps 116 illustrated in FIG. 10. Contact by the actuator members 72 will cause the described rotational and translational movement until all of the individual keycaps in each of the rails is positioned in a single printing plane.

FIG. 11 illustrates the principal of rotational and translational movement by which the keycaps assume a printing plane. FIGS. 12, 13 and 14 illustrate the same concept in detail. In FIG. 12, which is an end view of the printing fixture, the keycaps are mounted on the rails and there has been no movement of the rails and thus the keycaps are in an essentially keyboard profile. FIG. 13, which is a section through FIG. 9, shows the bottom of each of the rails as spaced from the down stop adjustment screws 117 which will support the interior of the rails after movement. The distance that the bottom of each rail is above its adjustment screw is the distance which each rail will move when the rails are contacted by actuator members 72. The individual springs 100 hold each of the rails against up stops 111 in the up position of FIGS. 12 and 13, and the top 110 of each of the stops 104 is spaced from the flanges of the respective bearings. When each of the rails is contacted by actuator members 72, the rails will move both downward (translationally) and pivotally until the individual rails assume the position in FIG. 14. The top surface of each keycap in each rail is now in the same plane. The bottom of each rail is in contact with adjustment down stops and screws 117 and the rails have pivoted to different angular positions in order for the keycaps to all have their tops in the same printing plane. Pivotal movement of the rails is facilitated by the arcuate lower areas 120 thereof. The rails move translationally, or downward, different amounts, again so that the keycaps, which are different in profile from rail to rail, all have the upper surfaces thereof in the same plane.

Each keyboard array will have keys, space bars and other functional elements at somewhat differing positions. In any such keyboard array there will be gaps or spaces, usualy at least a keycap in size. In order for there to be a successful transfer of the legends from the legend carrying medium or paper 70 to the individual keycaps without damage to the printing bladder, it is necessary that the bladder be universally supported during the printing process. Accordingly, there, are so-called filler keys which are positioned on the rails and are used to fill in any spaces left when the keycaps to be printed are positioned upon the rails. The pedestals are adjusted, not only to properly position the keycaps to be printed, but also to properly position the filler keycaps which will close or fill in any gaps left in the normal keyboard array so that the entire surface of the array of keycaps is essentially continuous and will provide universal support for the printing bladder during the printing process.

In the printing process itself, the initial step, after the keycaps have been properly positioned upon the rails in an essentially keyboard profile and array, is for the fixtures 14 to be positioned upon the transfer frame bed 54. Positioning elements 78, 80 and 82 are utilized for this purpose. Each fixture has sleeves 121 (FIG. 10) for mounting the fixture upon the positioning elements.

After the fixtures have been so positioned, arms 40 and the associated cross braces are moved from, the initial position of FIG. 1 down onto bed 54 and the arms are locked in position by the above-described air cylinders 64 and projecting pins 66. As the arms are moved down, the actuator elements 72 fixed thereto will contact the actuator keycaps at the end of each rail and will cause the keycaps and the rails to move from the FIG. 12 position to the FIG. 14 position.

Next, the legend carrying medium 70, which is preferably a suitable paper having legends or characters formed of transferable dye in designated areas thereon, is positioned on top of the printing fixture. There are alignment elements 130, 132, and 134, illustrated in FIG. 3, formed on the top of cross braces 56 and 58 so that paper 70 is properly positioned. At this time a low vacuum is applied to the inside of the cross braces with the result that the holes 69 will apply a small degree of suction to the lower surface of paper 70 to hold the paper in position on top of the printing fixture.

The transfer frame is then, moved, as a unit, to a position underneath printing platen 10 in which the printing fixture is aligned with one portion of the bladder. Maximum electric current is applied to the heating rod within the bladder chamber. Normally, a stable temperature will be maintained at all times in chamber 26 when the printing apparatus is in use, with only maximum current being applied to the heating element at such time as a printing operation will actually take place. Thus, there is only a short warm-up time required during which the temperature of chamber 26 and bladder 22 is raised up to a printing temperature. At the same time as maximum heat is applied to the heating element, high pressure is applied to chamber 26 and a high vacuum is applied to the vacuum system holding paper 70 in position.

Printing platen 10 is moved down upon the printing fixture and the heat and pressure from the bladder is applied for a predetermined period of time sufficient to transfer the legend from paper 70 onto the tops of the individual keycaps. A 70 second dwell time has been found to be satisfactory for sublimation printing of the type performed by the disclosed apparatus. During the printing cycle, with the temperature at the bladder itself being on the order of 350° F. which is sufficient to sublimate or vaporize the dye or ink on paper 70 and transfer the image to the individual keycaps.

At the conclusion of the printing cycle, the pressure in chamber 26 is reduced from the high pressure used for printing and after a ten second time delay the printing platen will move up after which the shuttle will move the transfer frame from its position beneath the platen to a position wherein the operator can have access to the individual printing fixtures. Vacuum is released and the used paper may be removed from the top of the printing fixture and discarded.

Of importance in the invention is the fact that through the use of an air pressure activated heated bladder the printing apparatus can successively print keyboards of any array of keycaps. The bladder is universally supported by the keycaps and filler keycaps where required and there need be no alignment of any portion of the bladder with any particular keycap as is required in prior art devices which used heated pads for the transfer of a legend from a medium such as a paper onto the individual keycaps. As long as the keycaps ar arrayed in an essentially single plane, all will be printed simultaneously without regard to the position of the keycaps within the keyboard array.

Of further importance is the printing fixture which enables keycaps placed in an essentially keyboard profile to be moved, just prior to the printing operation, into an essentially planar printing profile. The individual rails are movable both in a translational direction and rotationally or pivotally, whereby the rails and the associated keycaps will be moved to the essentially planar printing plane.

Whereas the preferred form of the invention has been shown and described herein, it should be realized that there may be many modifications, substitutions and alterations thereto.

The embodiments of the invention in which an exclusive property or privilege is claimed are defined as follows:

1. An apparatus for printing keyboard keycaps including a fixture for holding multiple keycaps in an essentially keyboard profile, said fixture including means supporting said keycaps in separately movable rows each having multiple keycaps, each row of keycaps being supported on said fixture for both pivotal movement and up and down translational movement, means for moving the separately movable segments from an essentially keyboard profile into an essentially planar printing profile, printing means including an air inflatable heated bladder positioned to apply heat and pressure to a legend carrying medium positioned upon the keycaps to transfer the legends from the medium to the individual keycaps.

2. The apparatus of claim 1 further characterized in that said air inflatable heated bladder is generally uniformly supported over the area of the keyboard while applying heat and pressure to a legend carrying medium for transferring the legends from the medium to the individual keycaps.

3. The apparatus of claim 2 further characterized in that said bladder uniform support is provided by keycaps extending over the entire area of the keyboard, less than all of said keycaps are positioned to receive legends from said legend carrying medium.

4. The apparatus of claim 1 further characterized in that said separately movable segments are rows of keycaps, with each row of keycaps being supported on said fixture for both pivotal movement and up and down movement.

5. The apparatus of claim 1 further characterized in that each of said rows of multiple keycaps carry, at least at one end thereof, a blank actuator keycap for use in moving a row from a position in which its keycaps are part of the essentially keyboard profile to a position in which its keycaps are within the planar printing profile.

6. The apparatus of claim 1 further characterized in that within each row, each of said multiple keycaps is movable axially along the row.

7. The apparatus of claim 1 further characterized by and including a shuttle mounting said fixture for movement toward and away from said printing means.

8. The apparatus of claim 7 further characterized in that said means for moving the separately movable rows of multiple keycaps from an essentially keyboard profile into an essentially planar printing profile is a part of said shuttle.

9. The apparatus of claim 1 further characterized in that said printing means includes a chamber, with said bladder closing one side of said chamber, a heating element and a reflector positioned within said chamber with the reflector being positioned to direct reflected heat toward said bladder.

10. The apparatus of claim 9 further characterized in that said bladder is formed of a silicone rubber material, said heater element is electrically operated and said reflector has a generally parabolic shape with said heater being positioned at the focus of said parabolic shape.

* * * * *